US009808843B2

(12) United States Patent
Klingen et al.

(10) Patent No.: US 9,808,843 B2
(45) Date of Patent: Nov. 7, 2017

(54) WIRE ROLL STAND WITH INDIVIDUAL DRIVE

(75) Inventors: Hermann-Josef Klingen, Moers (DE); Siegmund Bulert, Wuppertal (DE); Detlef Breunung, Hilden (DE); Guido Sonnenschein, Baesweiler (DE); Friedhelm Schellscheidt, Ratingen (DE); Thomas Nerzak, Gelsenkirchen (DE); Frank Theobald, Siegen (DE)

(73) Assignee: SMS MEER GMBH, Moenchengladbach (DE)

( * ) Notice: Subject to any disclaimer, the term of this patent is extended or adjusted under 35 U.S.C. 154(b) by 1210 days.

(21) Appl. No.: 13/498,654

(22) PCT Filed: Oct. 26, 2010

(86) PCT No.: PCT/EP2010/006514

§ 371 (c)(1),
(2), (4) Date: May 21, 2012

(87) PCT Pub. No.: WO2011/054461

PCT Pub. Date: May 12, 2011

(65) Prior Publication Data

US 2012/0216588 A1 Aug. 30, 2012

(30) Foreign Application Priority Data

Oct. 26, 2009 (DE) ..... 10 2009 050 710

(51) Int. Cl.

| | |
|---|---|
| ***B21B 35/04*** | (2006.01) |
| ***B21B 1/18*** | (2006.01) |
| ***B21B 13/00*** | (2006.01) |

(52) U.S. Cl.
CPC ..... *B21B 35/04* (2013.01); *B21B 1/18* (2013.01); *B21B 13/005* (2013.01)

(58) Field of Classification Search
CPC ..... B21B 35/04; B21B 13/005; B21B 13/08; B21B 13/10; B21B 13/103; B21B 13/00;
(Continued)

(56) References Cited

U.S. PATENT DOCUMENTS 3,945,234 A * 3/1976 Steinbock ..... 72/235
6,035,687 A 3/2000 Grimmel
(Continued)

FOREIGN PATENT DOCUMENTS

CN 2139035 Y 7/1993
CN 1179367 A 4/1998
(Continued)

OTHER PUBLICATIONS

Machine Translation of DE928703.*

*Primary Examiner* — R. K. Arundale
*Assistant Examiner* — Mohammad Yusuf
(74) *Attorney, Agent, or Firm* — Andrew Wilford

(57) ABSTRACT

The invention relates to a roll stand (1) as a constituent part of a roll stand group (2) in a high-speed wire mill, having at least one roll pair or roll ring pair (5) and a drive shaft (7) which is connected to a motor (6), characterized in that each roll stand (1) of this roll stand group (2) is assigned a motor (6) and a drive shaft (7), and the motor (6), the drive shaft (7) and the at least one roll pair or roll ring pair (5) are arranged linearly with respect to one another.

11 Claims, 4 Drawing Sheets

(58) Field of Classification Search
CPC .. B21B 35/00; B21B 1/00; B21B 1/18; B21B 1/16; B21B 35/02; B21B 2203/26; B21B 2275/02; B21B 2275/05; B21B 2275/04; B21B 38/008
USPC ..... 72/249
See application file for complete search history.

(56) References Cited

U.S. PATENT DOCUMENTS

| | | | | |
|---|---|---|---|---|
| 6,085,565 | A | 7/2000 | Suda | |
| 6,205,835 | B1 * | 3/2001 | Balve | B21B 1/18 72/226 |
| 7,191,629 | B1 | 3/2007 | Shore et al. | |
| 7,719,224 | B2 * | 5/2010 | Quan | B41F 13/0045 318/560 |
| 2007/0227220 | A1 | 10/2007 | Compagnoni | |

FOREIGN PATENT DOCUMENTS

| | | | |
|---|---|---|---|
| DE | 928703 | B | 6/1955 |
| DE | 3109633 | A | 12/1981 |
| DE | 19625811 | A | 2/1997 |
| DE | 10263162 | A | 10/2003 |
| JP | 07323304 | B | 12/1995 |

* cited by examiner

WIRE ROLL STAND WITH INDIVIDUAL DRIVE

CROSS REFERENCE TO RELATED APPLICATIONS

This application is the US-national stage of PCT application PCT/EP2010/006514 filed 26 Oct. 2010, published 26 Oct. 2011 as WO2011/054461, and claiming the priority of German patent application 102009050710.8 itself filed 26 Oct. 2009.

FIELD OF THE INVENTION

The invention relates to a roll stand as a part of a roll-stand group in a high-speed wire rod mill line, with at least one pair of rolls or pair of roll rings and a drive shaft connected to a motor.

PRIOR ART

Roll stands of the type under discussion are usually arranged in blocks one downstream of the other and change the cross section of a workpiece as it passes through successive pairs of rolls or roll rings in roll stands in roll-stand groups. In the field of high-speed wire rod mill lines the rod wire when passing through the finishing units of the wire rod rolling mills and above all when exiting from the last roll stand is conveyed at final roll speeds of more than 60 m/sec, preferably in the range of up to 130 m/sec.

In general, high-speed wire/rod mill lines are formed by a plurality of individual roll stands arranged one downstream of the other, which together or separately produce a roughing mill, an intermediate mill and a finishing mill, optionally with the use of a prefinisher between the intermediate mill and the finishing mill. The finishing mill in turn usually comprises a prefinisher as well as a finishing unit, optionally with a downstream unit for final sizing. The present invention relates to the above-mentioned finishing mill in a high-speed wire rod mill line, thus the prefinisher, the finishing unit and optionally the downstream sizing unit.

The prefinishers and finishing units used in wire rod rolling mills of this type are usually formed by a number of individual roll stands arranged one downstream of the other, with adjusters assigned thereto for the roll gaps and roll fittings for guiding the rolled product. The individual roll stands are thereby preferably arranged on a common base frame and the rolls of these stands, preferably in the form of roll rings, are usually cantilevered on respective support shafts. In turn, the pairs of support shafts are driven via transmissions of spur gear and bevel gear combinations jointly mounted on the base frame via longitudinal shafts arranged on both sides of the stand row.

Roll stand arrangements of this type are described by way of example in DE 199 19 778 [U.S. Pat. No. 6,035,637], DE 198 00 201, DE 196 25 811, DE 102 61 632, and DE 3 109 633.

The stands of each unit are thereby generally arranged in a V shape (the roll stands are arranged in a V-shaped manner relative one another and all of the roll stands are arranged obliquely at a predetermined angle to the mill floor) or also in a H-V shape (the roll stands are arranged in a V-shape relative one another, with one half is arranged horizontally parallel to the mill floor and the other half vertically perpendicular to the mill floor) relative one another alternately with predetermined angular offset such that the odd-number roll stands extend to a first side of the roll block and the even-number roll stands extend to a second side of the roll block, or vice versa.

The longitudinal shafts on both sides of a roll block of this type are in turn driven from a common transfer case with a common motor or with several motors connected in series. The drive of the individual roll stands is finally effected via a drive of the pairs of support shafts and finally via transmissions of spur gear and bevel gear combinations carried on the rolls or roll rings via the support shafts and jointly mounted on the base frame, where necessarily nonstraight and bent transmissions or drive shafts are arranged between the longitudinal shafts and the individual rolls or roll rings of each roll stand. A diagrammatic view of such drives used in the prior art is shown in FIG. 1. It is discernible therefrom that the bend in the drive-transmission takes place spatially about two angles of usually 90° and 45°.

Known prefinishers or finishing units of this design are formed by two, four, six, eight, or ten stands. Depending on the material quality to be produced, combinations of roll blocks, such as, e.g. 6+4 or 8+4 stands are also used at the wire outlet. However, each of these blocks has separate transfer cases for connection to the longitudinal shafts.

The cross-sectional changes that the rolled product undergoes consecutively in the stands are thereby completely established by the drive concept and the necessary transmission system. A change in the cross-sectional reduction thereby requires the use of complex control gears or the change or the replacement of individual gear ratios. Because of the fixed ratio of each transmission system, for each change of the outlet diameter of the wire a corresponding change of the inlet and run cross sections of the grooves of the rolls of all stands is necessary, which necessitates the laborious replacement of all roll rings or a comprehensive and complex set of rolls. This leads to conversion times of greater or lesser length on the stand, during which upstream and downstream regions of the wire rod mill line must also shut down.

According to experience, with such fixed transmission systems the roll-ring diameter of a groove row can deviate from one another only by relatively small amounts of about +/−0.5 mm, since otherwise the longitudinal tension or longitudinal pressure of the wire rod strand cannot be adjusted in a controlled manner. The total format change of the wire when passing through the finishing unit instead is fixed and cannot be varied. With some types of material, this easily leads to overheating in the rolled product core or to exceeding the limit of shape change of the material. An adaptation of the cross sectional acceptance per roll pass is therefore not possible; instead according to the present prior art it would require the use of a prefinisher or finishing unit with correspondingly different ratios by means of control gears of the entire transmission arrangement.

The mechanical transmission system in turn, due to the plurality of masses capable of rotational vibration, has several natural resonance frequencies, which can be controlled only to a limited extent by a common drive motor with its high mass moment of inertia. This can mean that a wire mill cannot use certain speed ranges in an operationally safe manner.

OBJECT OF THE INVENTION

The object of the invention is to provide a roll stand in a prefinisher or a finishing unit of a high-speed wire rod mill line in which the total shape change can be varied in a highly flexible manner and in which a change of the cross-sectional reduction per roll pass is possible with simultaneous free selection of the roll-ring diameter, the number of roll stands and the spacings of the roll stands from one another.

This object is attained as defined by the invention by means of a roll stand comprising the features of claim 1. Advantageous embodiments of the invention are defined in the dependent claims.

SUMMARY OF THE INVENTION

The invention relates to devices in high-speed wire rod mill lines. Mill lines of this type are operated with exit speeds of the wire out of the last roll stage of about 60 to 130 m/s, the final cross sections of the wire being usually about 4-20 mm, preferably 5-16 mm. With such speeds of the wire and the angular speeds associated therewith especially of the shafts for the rolls or roll rings, friction bearings instead of the otherwise customary antifriction bearings are used.

For technological reasons regarding roll quality (wire guidance), high-speed wire roll mill lines of this type have a roll stand spacing of respectively 800-1000 mm.

As defined by the invention, each roll stand has its own drive with respective motor and respective drive shaft, wherein the motor, the drive shaft and at least one pair of rolls or pair of roll rings are aligned in a respective straight line with one another. As defined by the invention, the straight-line arrangement relates to an essentially straight arrangement without bends and accordingly without having to use the otherwise necessary special transmission arrangement, such as for instance bevel gear arrangements. The drive is hereby realized with particularly simple means with very high reliability and flexibility with regard to control and the installation space thereof is limited to a minimum.

Thus the transmission structure is substantially simplified compared to the prior art and is limited to a transmission driving the individual rolls or roll rings between the auxiliary shafts of these rolls or roll rings and the drive shaft for the respective roll stand, optionally additionally a transmission. The bevel gear stage otherwise necessary for the power flow deflection can be omitted, which also leads to the reduction of the rotating masses and to increased torsional stiffness in the roll stand.

Within the individual roll stands a coordination in terms of vibration engineering of the individual mechanical and electrical drive parts to one another can be carried out. The natural frequencies can thus be individually adjusted, which influences the entire vibration behavior. Furthermore, an optionally provided controller can be adjusted in terms of vibration engineering to each individual roll stand. Furthermore, preferably adjustable notch filters can be used, which can counteract a remaining resonance for each drive train. This also opens up the possibility of using individual notch filters for each roll stand.

The invention renders possible an optimization of the tension ratios between the stands, which can lead to a reduce friction in the roll gap and thus to an improvement in quality and significant increase in the roll service life. Due to the possibility of selecting free angular speed ratios with the drives of the individual stands, a targeted grading of the cross section reductions, for example in the finishing unit of the high-speed wire rod mill line is possible. This permits a flexible decrease distribution, in order, for example, through a declining decrease grading to reduce the overall heating in the core of the rod wire.

Optimal adjustments to desired cross-sectional sizes and tolerances are possible by means of a possible combination of large reductions in the first stand with precision reductions in the last stands.

Since it is no longer necessary for a respective conversion of an entire module, for example, of the finishing block of a wire rod mill line, for each change of the outlet cross section, the necessary stoppage times of the rod mill line are reduced overall as well as of the upstream and downstream assemblies, which leads to an increase in productivity of the mill line as a whole.

The free selection possibility of the reductions and of the longitudinal tension between the stands furthermore permits material-adapted and cross-sectionally oriented deformations and degrees of deformation effectiveness which can reduce the power consumption for each individual roll stand and the mill line as a whole. Likewise by means of the individual change of the longitudinal tension between the roll stands, an influence of the cross section is possible, whereby a length-dependent cross section error, preferably in the case of thickened wire ends, can be reduced.

By means of a preferably present automatic adjustment of the roll gaps and the fittings of each roll stand, optionally different finished cross sections can be rolled with the same blooming grooves of the rolls, whereby a further reduction of the conversion and stoppage times can be achieved. Since the individual roll stands with assembled roll rings and roll fittings can be exchanged proportionally for other roll stands and the angular speed adjustment can preferably take place via controller, it is furthermore possible to vary the reduction inside the block with unchanged inlet cross section of the wire.

The possibility of free selection of the roll-ring diameter thereby permits a better utilization of the roll rings, since new and old rings can be combined. Through the adaptation of the roll gap adjustments, the oval or round grooves can be used at each desired point in the finishing unit. Since overall rigid groove rows are no longer present, preferably only a dressing of the respective rolls or roll rings corresponding to the wear is necessary, whereby the respective service life of the individual rolls or roll rings can be increased.

With a prefinisher and finishing unit system according to the invention, preferably only the roll stands involved in the rolling process can be driven at high speed. The stands not involved can rotate at any desired slow idle speed, whereby high angular speeds difficult to control in terms of bearing technology are avoided.

Overall, the free selection possibility of the assignment of the individual stands within the prefinisher or finishing unit permits a targeted adjustment of the spacings between the individual stands, wherein these spacings in turn can be used in a targeted manner as a cooling stretch or compensation stretch. The fixed connection previously specified in the prior art between the inlet cross section and the outlet cross section of a roll-stand group comprising respectively several roll stands, so-called modules, therefore in terms of the invention preferably does not exist, since desired changes of the outlet cross section no longer inevitably requires a change in the inlet cross section and the associated change of all rolls or roll rings and grooves.

In general, due to variations in the cross section reduction in a high-speed wire rod mill line according to the invention from an individual leading pass section a large number of different final cross sections can be rolled in the same prefinisher or finishing unit. The failure of individual roll stands thereby does not inevitably lead to the stoppage of the entire wire rod mill line, in fact while circumventing individual failed or switched off roll stands, the rolling operation can be further continued for a large part of roll products.

According to the invention due to the reduced inertia compared to roll modules using longitudinal shafts, formed by at least two roll stands with a common drive, so-called modules, a clearly improved correction time of the drive train can be achieved, whereby the dynamic behavior of the roll-stand group or of the block as a whole and in particular during the leading pass operation is improved. This high dynamic and the preferred coordination in terms of vibration engineering of the individual mechanical and electrical drive parts to one another reduces the risk of dangerous resonances, which overall leads to a safer operation in the entire speed range of high-speed wire rod mill lines.

The individual roll stands according to the invention are mechanically uncoupled from one another as far as possible so that the leading pass impact in one roll stand cannot excite natural resonance vibrations on other roll stands, which can ultimately result in a more stable operation in the entire speed range of the roll-stand group and optionally in the entire roll mill line.

The roll stand according to the invention is part of a roll-stand group, in particular of a prefinisher or finishing roll module of high-speed wire rod mill lines with at least two roll stands of this type. In prefinisher or finishing units of this type, the spacing of the respective roll stands from one another as well as the number thereof is stipulated. Such an arrangement by blocks also renders possible the connection to an optionally precalibrated control unit and furthermore the exchange of entire roll-stand groups without the necessity of having to exchange individual roll stands or sub-groups of roll stands.

The combination by blocks of several roll stands is thereby realized in a particularly advantageous manner if between two and twelve roll stands are combined with roll gap diameter coordinated with one another.

Furthermore, it is particularly preferred if the roll stands of the respective roll modules are arranged in an alternating manner with a predetermined angular offset to one another. This type of alternating arrangement is always realized when the angular offset between a first and its following roll stand is fixed. An alternating arrangement as defined by the invention is furthermore always realized when the roll stands with odd numbering, counted from the inlet side to the outlet side of the group, are arranged essentially parallel to one another and the roll stands with even numbering are likewise arranged parallel to one another between these roll stands with odd numbering or vice versa. The angular offset is accordingly realized between all of the roll stands with odd numbering and all of the roll stands with even numbering.

It is particularly preferred when the roll stands of the roll module are arranged in a V-shaped manner relative one another, wherein the angular offset defined above is preferably about 90°. However, a V-shape as defined by the invention can also be realized with a deviation from the right angle, for example, with an angular offset of 60 to 120°.

The roll stands can thereby preferably all be arranged at a predetermined angle of, for example, 45° to the mill floor, so that the accessibility to each roll stand of the roll-stand group is the same and optionally can be automated, wherein, however, the same effects can also essentially be achieved with a deviation of about +/−15°. In an alternative and likewise preferred embodiment of the invention, however, the roll stands are fixed in a so-called H-V arrangement to one another, wherein the angular offset is likewise about 90°. One half of the roll stands are hereby arranged horizontally (H), thus parallel to the mill floor, and one half is arranged vertically (V), thus in a perpendicular manner to the mill floor. In an further alternative and likewise preferred embodiment, the angular offset arrangement of the roll stands following one another is spiral-shaped or star-shaped with a constant angular offset of about 120° (star arrangement) or about 60° (spiral offset), wherein respectively after 3 and 6 offset steps the starting position is reached again and a rolling of the wire without the necessity of a twisting of the wire between individual roll stands or all roll stands is possible.

In a further alternative embodiment of the invention, the angular offset between the adjacent roll stands is 180°, however, whereby a completely flat arrangement of the prefinisher or finishing units can be achieved, which furthermore can be provided in each desired incline to the mill floor. A flat embodiment of this type, however, usually requires the use of suitable twisting elements for the wire at least between individual roll stands in order to thus render possible a round rolling of the wire.

By means of all of the above-mentioned alternatives in particular a simplified and also standardized structure with an opportunity of easy access to all of the roll stands and in particular to all of the roll stands of a module is provided, wherein above all in a 45° arrangement of all roll stands compared to the mill floor, an alternating arrangement of 90° of the respective roll stands relative one another is realized with corresponding symmetrical arrangement of the roll block as a whole.

As already mentioned at the outset, the deformation of the rod wire takes place with the action of at least two rolls or roll rings. However, the invention is not limited to the deformation of the wire with pairs of rolls or pairs of roll rings of this type. It is also preferred if three or four rolls or roll rings are assigned to at least one roll stand of a roll-stand group and the deformation of the material is caused in the roll gap formed by the three or four rolls or roll rings. The flexibility and application range of the roll stand according to the invention is hereby increased by particularly simple means.

As defined by the invention, an individual motor is provided for each roll stand, via which motor the rolls or roll rings are driven. It is particularly preferred if the motor is an electric motor or a hydraulic motor, which in a very preferred embodiment of the invention furthermore is designed so that it can be speed-regulated. Electric motors or hydraulic motors of this type are particularly space-saving and furthermore facilitate the straight-line arrangement of the drive train that is formed at least by the motor and drive shaft as well as optionally by a coupling.

Furthermore, a transmission is provided for the drive shaft in a preferred embodiment of the invention, which transmission is preferably integrated into the drive train. This transmission permits the provision of particularly high angular speeds, such as occur in high-speed wire rod mill lines, without the necessity of having to modulate the motor itself for this purpose or even having to replace it, since with high-speed wire rod mill lines of this type, angular speeds of the individual rolls of up to 17000 rpm occur, so the use of a transmission makes it possible for the angular speed to not be provided by the motor alone.

In a roll stand according to the invention, in addition to the motor and optionally to the transmission, an adjuster can also be assigned to the drive, via which adjuster the individual rolls or roll rings can be positioned relative to one another. A roll stand is hereby provided in which the roll gap can be adjusted in a preferably controlled manner, without for this purpose the rolls or the roll ring pairs having to be replaced, in order to effect a certain degree of deformation in the pass.

Advantageously, the drive of the individual roll stands combined in groups takes place via respective controllers, in particular via a common controller to which the respective motors are connected.

A controller of this type can be used not only to advantageously adjust the longitudinal tension and longitudinal pressure between two adjacent roll stands within each roll-stand group, but also can suppress the occurrence of resonance vibrations within a roll stand or the entire system or at least damp them in a stand-specific manner.

A controller is particularly preferred that processes angular-speed set points of the respective drive trains of the individual roll stands based on technological specifications, such as, for instance, the rolled product material, the maximum deformation values of this material, the roll stand constants, the inlet and outlet cross sections, the inlet temperature, the available roll sets, the batch sizes and/or the identification numbers and optionally dressing measurements of the rolls.

A controller is particularly preferred that is connected to measuring sensors that determine actual values at least for the angular speed of the respective drive trains. Based on this actual value determination, it will be possible to compare the previously determined desired angular speed values and actual angular speed values. This takes place in a very preferred manner using controllable drive operators for electric motors or hydraulic motors in the respective roll stands.

The controller can synchronize the angular speed preferably of each roll stand dynamically with the angular speed of at least one adjacent roll stand, preferably with the angular speeds of all of the roll stands combined in the modular manner.

BRIEF DESCRIPTION OF THE FIGURES

The invention is explained in more detail below with reference to four FIGS. 1-4, in which FIG. 1 represents the prior art, FIGS. 1-3 [2-4] in contrast represent diagrammatically preferred embodiments of the invention. Therein:

WAYS OF CARRYING OUT THE INVENTION

Figure 1A:
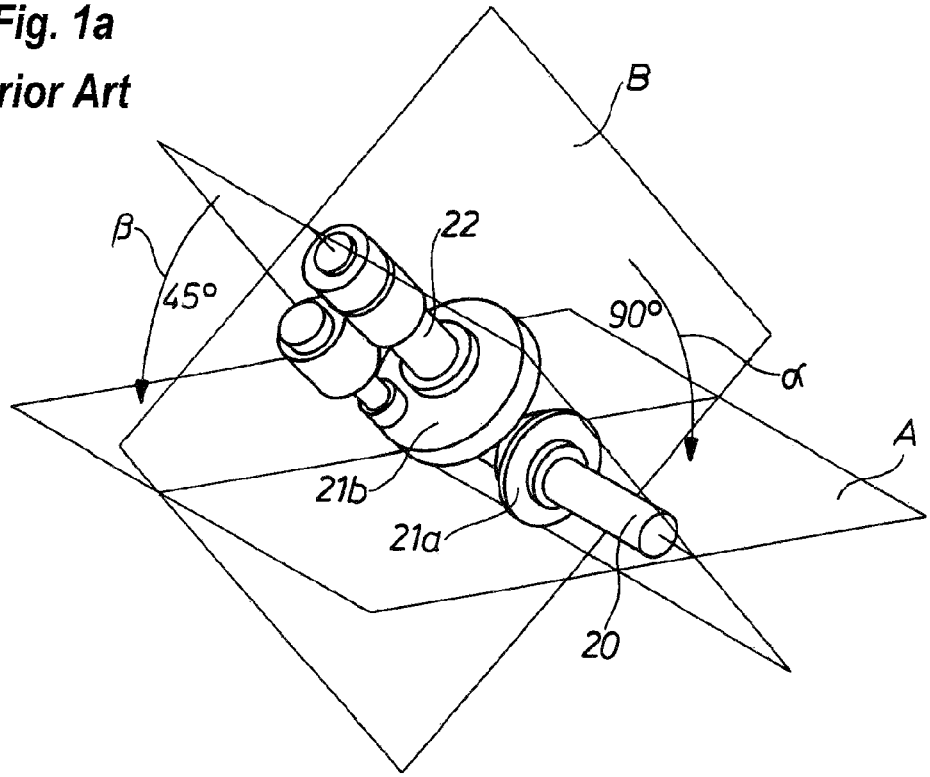
Fig. 1a Prior Art
FIG. 1*a* is a diagrammatic detail view of a drive train of a wire roll stand according to the prior art as well as an illustration of the bend angle inside the drive.
Figure 1B:
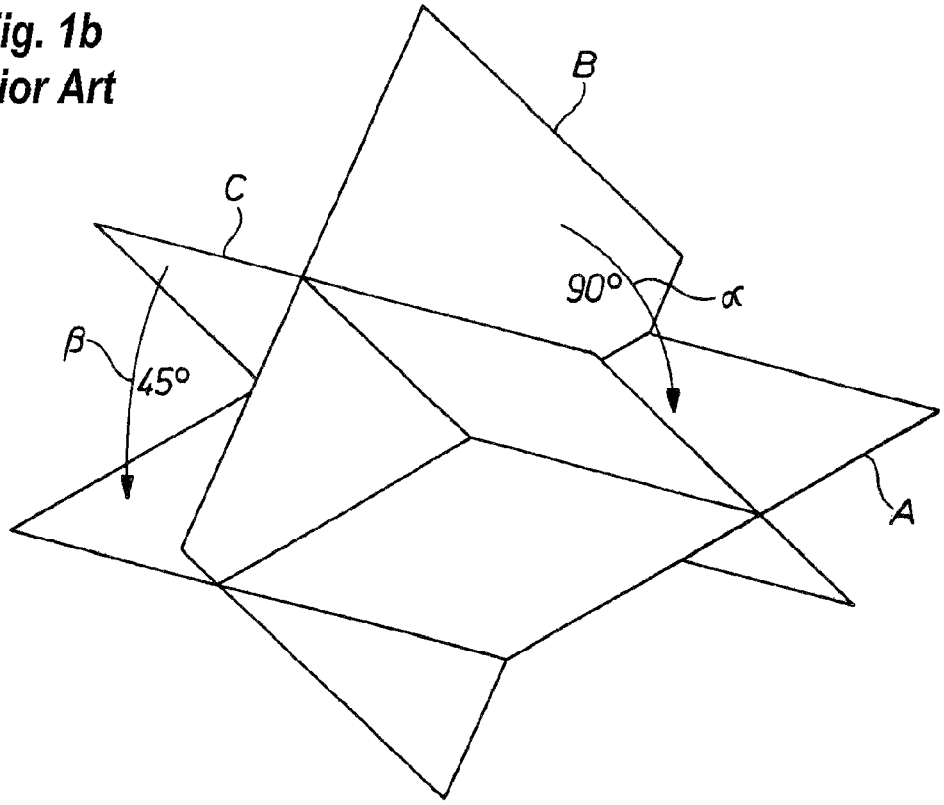
Fig. 1b Prior Art
FIG. 1*b* shows the bend angle from FIG. 1*a*.

FIG. 1*a* shows a diagrammatic sectional view of a drive train of a wire roll stand (not shown) according to the prior art as well as an illustration of the bend angle α, β between the planes A, B, C inside the drive. Half of the roll stands of a roll block arranged in a V-shape at an angle of 45° to the mill floor are driven via a common drive shaft 20. The roll stand drive shaft 22 is driven via a bevel gear transmission 21, comprising two bevel gears 21*a*, 21*b* set at an angle of 90° to one another. This roll stand drive shaft 22 in turn extends (not shown) to a transmission (not shown) for driving the rolls or roll rings (not shown) of the roll stand. The entire drive of the roll stand according to the prior art thus has two spatial bends or deflections, namely a first bend by an angle α=90° between the plane A parallel to the mill floor and in which the drive shaft 20 extends, and plane B that is perpendicular to the plane A and in which the roll stand drive shaft 22 extends, as well as a second bend at an angle β=45° between the plane A and the plane C in which the roll stand drive shaft 22 also extends. FIG. 1*b* shows these planes A, B, C as well as their angular offset to one another again separately for easier comprehension, without showing the transmission arrangement from FIG. 1*a*.

Figure 2:
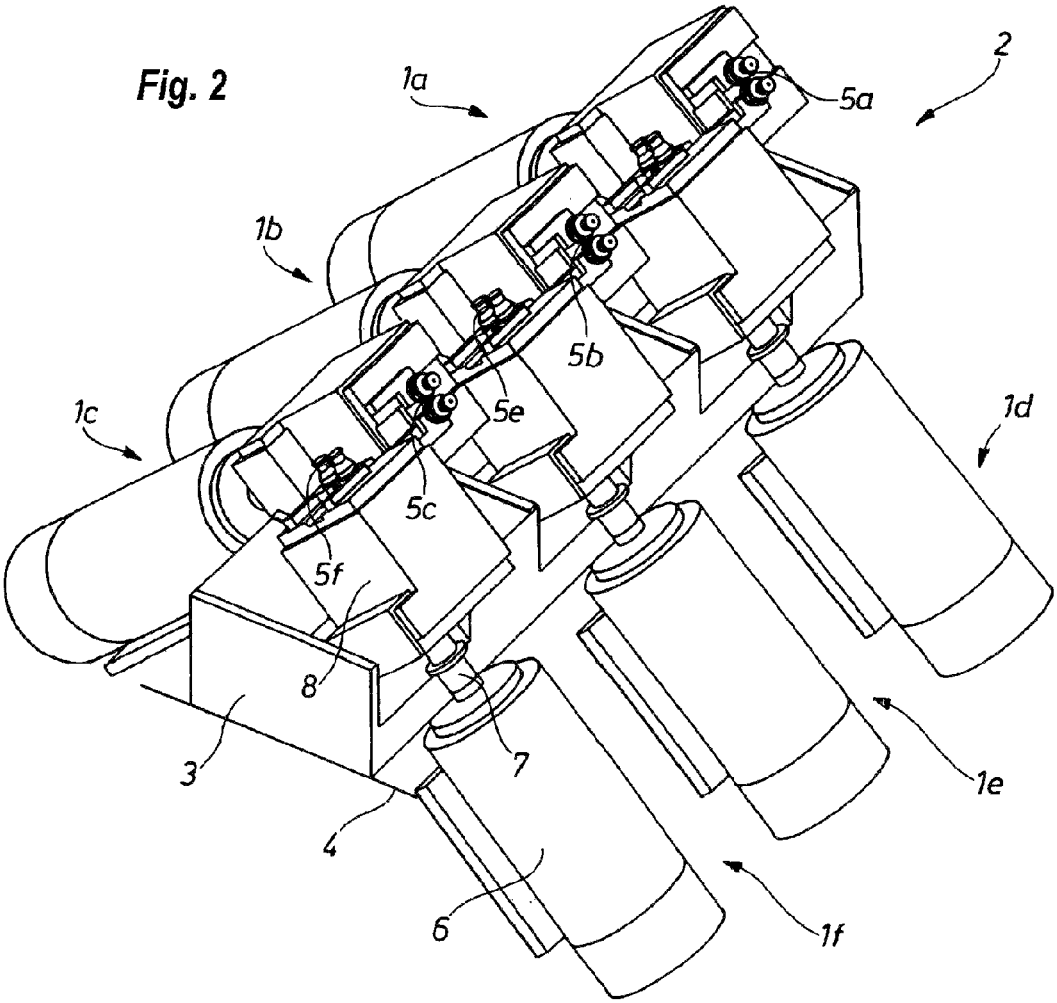
FIG. 2 is a diagrammatic plan view of a roll block comprising six roll stands.

FIG. 2 shows a roll-stand group 2 having roll stands 1*a*-1*f* mounted on a roll block 3. The roll stands 1*a*-1*f* extend at an angle of 45° to the mill floor 4 relative one another with the left-side roll stands 1*a, b, c* alternate with the right-side roll stands 1*d, e, f* at an angle of 90° to one another. The roll stands 1*a*-1*f* are mounted in the roll block 3 such that the roll gaps of the respective roll pairs 5*a*-5*f* are essentially aligned with respect to one another so that a wire (not shown) can be guided without bends or kinks through all of the roll stands 1*a*-1*f* of the roll-stand group 2. The individual roll stands 1*a*-1*f* each basically have a motor 6, a drive shaft 7, a transmission 8 and finally the respective pair of rolls 5. As shown, these parts 5, 6, 7, 8 of each roll stand 1 are arranged in a straight line with one another without spur gear and bevel gear combinations and without the necessity of longitudinal shafts running along the roll block 3. The longitudinal axes of these parts 5, 6, 7, 8 accordingly lie essentially on one line, so that in particular in the region of the rolls of course parallel displacement can be carried out to the extent predetermined by the transmission arrangement 8 overall, without hereby deviating from the principle of the straight-line arrangement in the respective roll stand 1*a*-1*f*.

Figure 3:
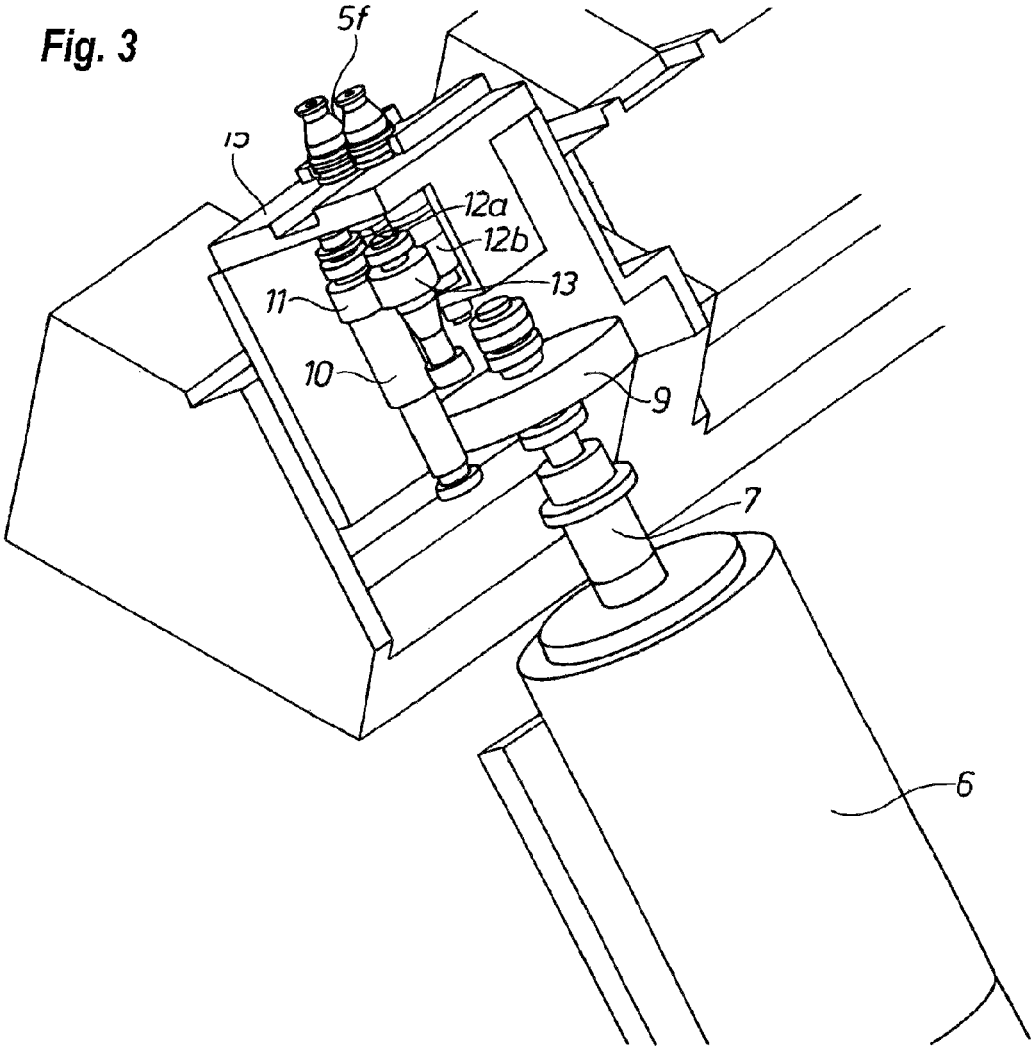
FIG. 3 is an enlarged view of a detail of a transmission structure in one of the roll stands from FIG. 1.

FIG. 3 shows an enlarged plan view of the transmission 8 of the roll stand if from FIG. 1, which serves as speed-change transmission and drive transmission. As shown, the transmission 8 is between the motor 6 and the drive shaft 7 on the one side and the pair of rolls 5*f*. At the end of the drive shaft 7 facing the pair of rolls 5*f*, is a transmission gear 9 (indicated diagrammatically) that meshes with an intermediate shaft 10 for the rolls of the pair of rolls 5*f*. A predetermined ratio between the angular speed of the drive shaft 7 and the angular speed of the intermediate shaft 10 is the result of the different number of teeth of the gears of the drive shaft 7 and the intermediate shaft 10. A transmission gear 11 shrunk on the intermediate shaft 10 in turn meshes with a roll drive shaft 12*a* for a roll of the pair of rolls 5*f* and with the auxiliary shaft 13 that in turn meshes with the second roll drive shaft 12*b* for a roll of the pair of rolls 5*f*, with a predetermined gear ratio between the intermediate shaft 10 or the auxiliary shaft 13 and the roll drive shafts 12*a*, 12*b*, the two roll drive shafts 12*a*, 12*b* being driven at the same angular speed but with different rotation directions. Replacement of the rolls 5*f* is done individually or by pairs, while changing the drive shafts 12*a*, 12*b* preferably takes place with a module comprised of the pairs of rolls 5*f*, their roll drive shafts 12*a*, 12*b*, the holder plate 15, and the (unillustrated) adjuster for the roll gap pulled out of the speed-change transmission 8 and replaced by inserting a replacement module.

Figure 4:
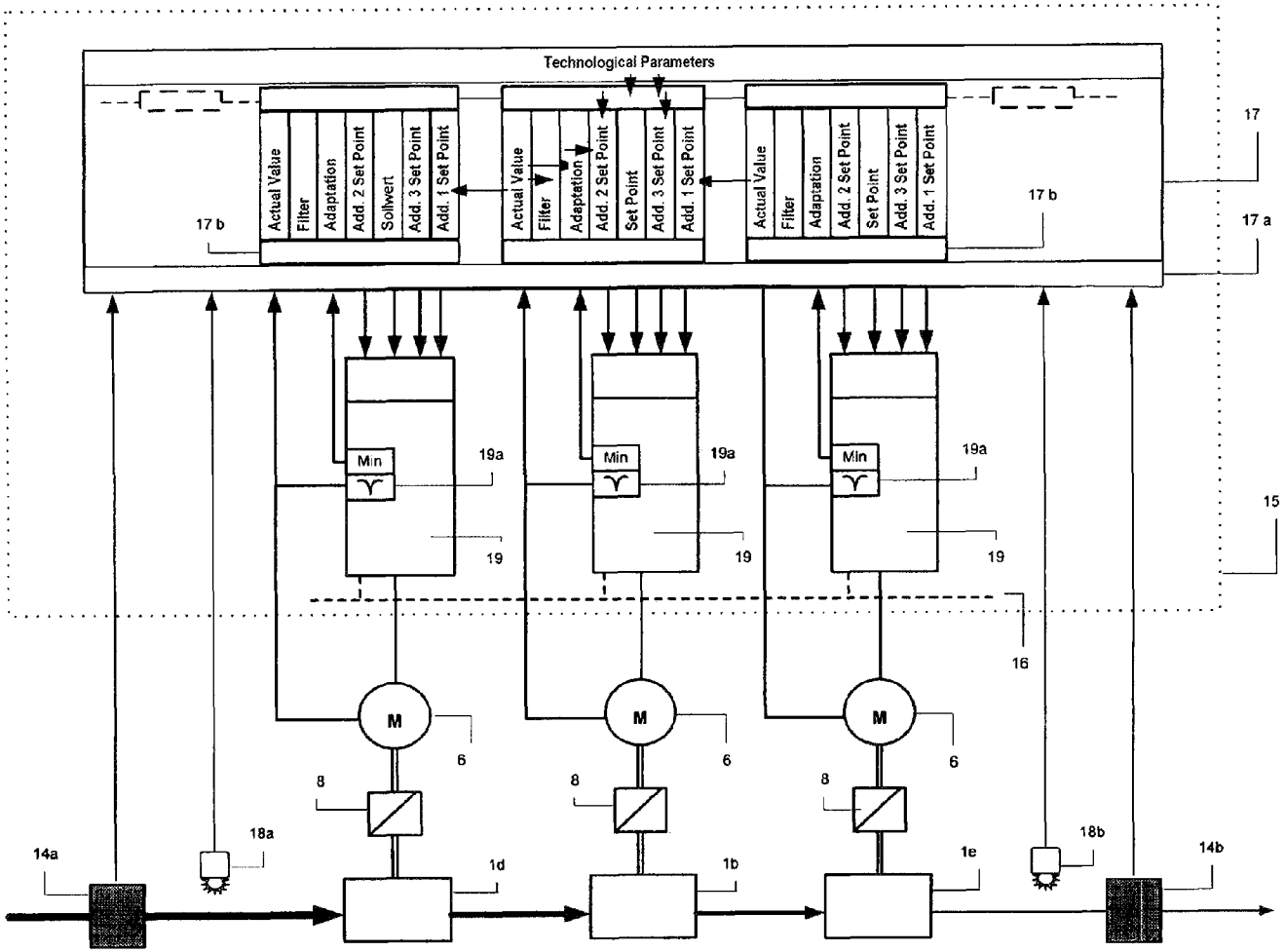
FIG. 4 is a schematic diagram of the electric controller for three roll stands connected one downstream of the other.

Finally FIG. 4 shows a circuit diagram of an example of an electric controller 15 for roll stands 1*d*, 1*b*, 1*e*, shown only by way of example. The controller 15 is comprised essentially of a computation unit 17 and respective drive operators 19. The controls (angular speed and torque) of each drive operator 19 can be adjusted individually in terms of vibration engineering for each roll stand. Furthermore, adjustable notch filters 19*a* counteract residual resonances for each drive train. The computation unit 17 is connected to all of the roll stands 1*d*, 1*b*, 1*e* of the roll module 2 and receives therefrom actual values of all measuring sensors. Relative the roll stands 1*d*, 1*b*, 1*e*, the angular speed of the respective motors 6 and the respective loads (motor current, torque and in the case of hydraulic motors pressure and flow) are measured. The computation unit 17 determines by means of technological and mechanical parameters the operating speed of the individual roll stands. The motors 6 of the individual roll stands are connected to one another by the computation unit 17 as well as via a drive data bus 16. A multi-layered, dynamic synchronization of the individual roll stands is thus achieved. Optionally dimension measuring devices 14*a* and 14*b* can be connected on the inlet side and outlet side to detect the dimensional change of the rod wire (height, width, ovalness). In the computation unit 17 a first additional desired angular speed value is derived from the nominal angular speed difference from the adjacent drive per roll stand 1*d*, 1*b*, 1*e*. To this end, the computation unit 17 is equipped with an observer that determines a dynamic real-time set point correction for each stand based on a mathematical model. The angular speed correction per stand is transmitted to the drive operators. Parallel to this, a nominal actual-value comparison of the speeds on the other roll stands is carried out via the drive data bus 16. The coupling of the angular speed controls can be controlled and is engaged and deactivated depending on the material tracking of the wire head in a stepwise manner. Material tracking is controlled by sensors 18*a*, 18*b* upstream of and downstream of the roll stands 1*d*, 1*b*, 1*e* by the motor currents and corrected by calculation depending on material speed and forward creep. The computation unit 17 is equipped with a further variable second additional set point for each roll stand, so as to limit for each roll stand 1*d*, 1*b*, 1*e* the individual drop in angular speed in the pass operation. This second additional set point is engaged or deactivated in a stepwise manner depending on the material tracking inside the computation unit. The effects of the second additional set point are monitored by measuring technology, evaluated in an adaptation algorithm and varied for the next pass. A third additional set point for the angular speed of each roll stand 1*d*, 1*b*, 1*e* serves to change the angular speed ratios of the roll stands to one another. The third additional set point can be derived from a manual correction or from a first computed value of the computation unit 17, which during the rolling with the aid of a mathematically simulation model represents the tension pressure ratios, or from a second computed value, which comes for example from the dimension-measuring devices 14*a*, 14*b* upstream or downstream of the roll stands 1*d*, 1*b*, 1*e* and the computed shape and diameter deviation. The third additional set point can be engaged or deactivated in a stepwise manner depending on the material tracking. Furthermore, material tracking inside the computation unit 17 controls a state-dependent set point specification that defines different desired angular speed values for the case of threading, rolling and unthreading.

A memory circuit 17*b* detects the correction values currently determined and ensures an adaptive correction of the synchronization for the next rod wire.

The invention claimed is:

1. In a high speed wire rod mill line having a roll-stand group including a plurality of roll stands and outputting wire at a speed of 60 m/s to 130 m/s, the improvement wherein the roll stands are spaced at between 800 mm and 1000 mm, each roll stand has at least one pair of rolls or pair of roll rings, each roll stand has its own drive with a respective motor and a respective drive shaft for rotating the respective pair of rolls or roll rings at a respective angular speed, the motor, the drive shaft and the pair of rolls or pair of roll rings of each roll stand are aligned in a respective straight line with one another, and the motors of the roll-stand group are all connected to a common controller that synchronizes the angular speed of each roll stand dynamically with the angular speed of at least one adjacent roll stand with respect to longitudinal tension and pressure in such a manner as to suppress resonance vibration.

2. The roll stand according to claim 1, wherein the group of roll stands is part of a prefinisher or finishing roll unit.

3. The roll stand according to claim 1, wherein the roll-stand group comprises ten roll stands.

4. The roll stand according to claim 1, wherein the roll stands of the roll-stand group are arranged alternately with predetermined angular offset relative one another.

5. The roll stand according to claim 1, wherein the roll stands of the roll-stand group are arranged in a V-shape relative one another at an angular offset of about 90°.

6. The roll stand according to claim 1, wherein each roll stand is attached to a respective roll block at a predetermined angle to a mill floor.

7. The roll stand according to claim 6, wherein the predetermined angle is about 45°.

8. The roll stand according to claim 6, wherein the predetermined angle for a first half of the roll stands of the roll-stand group is about 90° and for a second half of the roll stands of the roll-stand group is about 180°.

9. The roll stand according to claim 1, wherein each motor is a controllable electric motor or hydraulic motor.

10. The roll stand according to claim 1, wherein a respective integrated transmission is provided for each drive shaft.

11. A high-speed wire rod mill line, comprising at least two roll stands according to claim 1.

* * * * *